US009417032B1

(12) United States Patent
Chiang

(10) Patent No.: US 9,417,032 B1
(45) Date of Patent: Aug. 16, 2016

(54) FIREARM STOCK AND RECOIL SYSTEM

(71) Applicant: GRIP PLUS INC, Menlo Park, CA (US)

(72) Inventor: Sai Chiang, Redwood City, CA (US)

(73) Assignee: GRIP PLUS, INC, Menlo Park, CA (US)

( * ) Notice: Subject to any disclaimer, the term of this patent is extended or adjusted under 35 U.S.C. 154(b) by 0 days.

(21) Appl. No.: 14/850,546

(22) Filed: Sep. 10, 2015

(51) Int. Cl.
*F41C 23/14* (2006.01)
*F41C 23/06* (2006.01)
*F41C 23/08* (2006.01)

(52) U.S. Cl.
CPC ..... *F41C 23/06* (2013.01); *F41C 23/08* (2013.01); *F41C 23/14* (2013.01)

(58) Field of Classification Search
CPC ..... F41C 23/14; F41C 23/12; F41C 23/20; F41C 23/06
USPC ..... 42/71.01, 73
See application file for complete search history.

(56) References Cited

U.S. PATENT DOCUMENTS 1,047,690 A * 12/1912 Oliver ..... F41C 23/14 42/73
1,909,171 A * 5/1933 Coupland ..... F41C 23/00 42/73
3,267,601 A * 8/1966 Roy ..... F41C 23/14 42/73
3,388,494 A * 6/1968 Kimball ..... F41C 23/06 42/73
8,186,090 B1 * 5/2012 Chiarolanza ..... F41C 23/04 42/73

* cited by examiner

*Primary Examiner* — Reginald Tillman, Jr.
(74) *Attorney, Agent, or Firm* — Parsons Behle & Latimer

(57) ABSTRACT

A firearm stock connection system that includes a grip with a first hole, a stock system with a second hole, and a button positioned within the first hole and extending through the second hole in an extended position. The stock system may include a frame member, a plate, an extender tube, and a lock. The extender tube may be threaded onto a threaded projection of the plate. The lock may prevent rotation of the extender tube with respect to the threaded projection. The extender tube may include structures that engage a portion of the lock. The structures may be a plurality of slots. The stock system may include a recoil device. The recoil device may be filled with gas. The grip may include a first end, a second end, a gap positioned between the first and second ends, and a bolt aperture extending from the first end to the gap.

13 Claims, 7 Drawing Sheets

FIREARM STOCK AND RECOIL SYSTEM

FIELD OF THE DISCLOSURE

The embodiments described herein relate to a firearm stock system. In one embodiment the stock may be incrementally adjusted in length. In some embodiments, the stock may utilize a recoil device. In some embodiments, the stock may include a quick-connect button to attach the stock to a grip. The grip may connect to a firearm receiver at an orientation and/or configuration different from known grips.

BACKGROUND

Description of the Related Art

Many shoulder-supported firearms are configured to allow a stock and grip to be replaced with a different configuration. However, it takes time to disconnect the stock from the firearm. For example, it may be necessary to remove multiple screws that secure the stock to the rest of the firearm. It may even be necessary to remove the butt plate before removing the stock. The time needed to disassemble the firearm may not be desirable. Additionally, the disassembly may require special tools, such as a screwdriver to complete disassembly. It may be beneficial to provide a stock that may be quickly disconnected from the grip of a firearm without the need for tools.

Furthermore, shoulder-supported firearms may connect the receiver to a grip with a bolt extending through the body of the grip. For example, a known over-and-under shotgun used in competitive clay pigeon shooting may use a bolt extending through a portion of the combined stock and grip and into the receiver. It is necessary for a user to remove the butt plate of the shotgun stock to access the bolt and remove the stock from the receiver. Not only is this connection burdensome to access, but it may inhibit the stock and grip placement. In trap shooting, a shooter shoots clay pigeons that have been released from a trap. The shooter tracks the placement of the pigeon with the sight of the gun. Unlike a rifle sight, a shotgun shooter's eye acts as the rear sight. Therefore, it is desirous to have proper alignment of the eye with the front sight to increase accuracy. Accordingly, a shooter presses the comb of the stock against the cheek to improve eye alignment. Relocation of the connection between the receiver and the grip may permit the grip and stock to be lowered in relation to the shotgun sight. The lowered position is advantageous because a shooter may use the lowered position as additional leverage and may more firmly press the comb of the stock against her face. Consequently, the shooter's eye alignment may increase. In addition, the lowered position may lower the center of gravity of the firearm and assist in absorbing recoil when fired. Furthermore, the relocation of the connection between the receiver and grip may no longer inhibit the use of an adjustable stock system attached to a portion of the grip opposite the receiver. Other disadvantages of current stock systems may exist.

SUMMARY

The present disclosure is directed to a system that overcomes some of the problems and disadvantages discussed above.

One embodiment is a firearm stock connection system comprising a grip having a first hole, a stock system having a frame member with a first side, a second side, and a second hole that extends from the first side to the second side of the frame member, and a button positioned within the first hole of the grip. The button includes a first end, a second end, an extended position, and a compressed position. In the extended position, a portion of the button extends through the second hole of the frame member and the first and second ends of the button are positioned outside of the frame member. In the compressed position, the first and second ends of the button are positioned within the frame member. The button selectively connects the grip to the frame member of the stock system when the button is in the extended position.

The firearm stock connection system may include a ferrule having a third hole that extends from a first side to a second side. The ferrule may be positioned on a portion of the grip and be positioned between the grip and the frame member. The button may extend through the third hole and the ferrule may retain the button within the first hole of the grip. The button may have a first portion and a second portion, the first portion being positioned within the first hole, and the second portion extending through the second hole. The second hole may have a smaller cross-section than a cross-section of the first hole.

The button may be biased in the extended position. The button may comprise a spring positioned between a first post and a second post, and a sleeve having a first end and a second end. A portion of the first post may extend beyond the first end of the sleeve and a portion of the second post may extend beyond the second end of the sleeve.

The grip may include a first end, a second end, a gap positioned between the first end and the second end, and a bolt aperture extending from the first end to the gap. The bolt aperture may be configured to receive a bolt. The bolt may attach the grip to a firearm receiver.

The system may include a plate connected to a first end of the frame member. The plate may have a threaded projection that extends toward a second end of the frame member. The system may include an extender tube with a first end and a second end. The extender tube may be positioned at least partially within the frame member. The first end of the extender tube may be threaded onto the threaded projection, wherein rotation of the extender tube in a first direction with respect to the threaded projection moves the second end of the extender tube away from the first end of the frame member and rotation of the extender tube in a second direction with respect to the threaded projection moves the second end of the extender tube towards the first end of the frame member. The system may include a lock having an engaged position and a disengaged position. The lock in the engaged position prevents rotation of the extender tube with respect to the threaded projection.

The lock may include a pin with a first end that engages a portion of the extender tube when the lock is in the engaged position. The pin may prevent rotation of the extender tube with respect to the threaded projection. The lock may include a pivot arm having a first end and a second end. The first end of the pivot arm may engage the pin. Actuation of the second end of the pivot arm may move the first end of the pin away from the extender tube.

The system may include a recoil device. The recoil device may have a cylinder and a piston. The cylinder may have a connector configured to attach a butt plate to the recoil device. The piston may have a piston head positioned within the cylinder and piston rod connected to the extender tube.

One embodiment is an adjustable firearm stock system comprising a frame member having a first end and a second end, a plate, an extender tube with a first end and a second end, and a lock. The plate is connected to the first end of the frame member and has a threaded projection that extends toward the second end of the frame member. The extender tube is positioned at least partially within the frame member. The first end of the extender tube is threaded onto the threaded projection, wherein rotation of the extender tube in a first direction with respect to the threaded projection moves the second end of the extender tube away from the first end of the frame member and rotation of the extender tube in a second direction with respect to the threaded projection moves the second end of the extender tube towards the first end of the frame member. The lock has an engaged position and a disengaged position, wherein the lock in the engaged position prevents rotation of the extender tube with respect to the threaded projection.

The lock may be contained within a lock plate. The lock plate may be connected to the second end of the frame member. The lock plate may include an aperture configured to allow the extender tube to rotate within the aperture when the lock is in the disengaged position. The extender tube may include at least one structure, wherein a portion of the lock in the engaged position engages the at least one structure to prevent rotation of the extender tube with respect to the threaded projection. The lock may include a pin with a first end that engages the at least one structure when the lock is in the engaged position. The pin may prevent rotation of the extender tube with respect to the threaded projection. The lock may include a pivot arm having a first end and a second end, the first end of the pivot arm engaging the pin, wherein actuating the second end of the pivot arm moves the first end of the pin away from the at least one structure. The lock may include a spring, wherein the spring may bias the first end of the pin in the engaged position with the at least one structure. The at least one structure may be a slot, cavity, groove, depression, or hole. The at least one structure may be four slots equidistantly positioned around the perimeter of the extender tube. The frame member may include an access aperture, wherein a member inserted through the access aperture may actuate the second end of the pivot arm.

The system may include a recoil device. The recoil device may dampen the recoil effect of a firearm. The recoil device may comprise a cylinder and a piston. The cylinder may have a connector configured to attach a butt plate to the recoil device. The piston may have a piston head positioned within the cylinder and a piston rod connected to the extender tube. A fluid may be positioned between the piston head and the cylinder. The fluid may be a gas. The cylinder may include a valve. The cylinder may be positioned at least partially within the extender tube and the connector may extend beyond the second end of the extender tube.

The frame member may have a first side, a second side, and a second hole that extends from the first side to the second side of the frame member. The system may include a grip with a first hole and a button positioned within the first hole of the grip. The button may have a first end, a second end, an extended position, and a compressed position. In the extended position, a portion of the button may extend through the second hole of the frame member and the first and second ends of the button may be positioned outside of the frame member. In the compressed position, the first and second ends of the button may be positioned within the frame member. The button may selectively connect the grip to the frame member of the stock system when the button is in the extended position.

One embodiment is a method to provide a firearm stock connection system, the method comprising providing a grip having a first hole. The method comprises providing a stock system having a frame member with a first side, a second side, and a second hole that extends from the first side to the second side of the frame member. The method comprises providing a button positioned within the first hole of the grip, the button having a first end, a second end, an extended position, and a compressed position, wherein in the extended position a portion of the button extends through the second hole of the frame member and the first and second ends of the button are positioned outside of the frame member, wherein in the compressed position the first and second ends of the button are positioned within the frame member, and wherein the button selectively connects the grip to the frame member of the stock system when the button is in the extended position.

The method may include providing a grip with a first end, a second end, a gap positioned between the first end and the second end, and a bolt aperture extending from the first end to the gap, wherein the bolt aperture is configured to receive a bolt, thereby attaching the grip to a firearm receiver.

The method may include providing a plate configured to connect to a first end of the frame member. The plate may have a threaded projection that extends toward a second end of the frame member. The method may include providing an extender tube having a first end and a second end. The extender tube may be positioned at least partially within the frame member. The first end of the extender tube may be threaded onto the threaded projection, wherein rotation of the extender tube in a first direction with respect to the threaded projection moves the second end of the extender tube away from the first end of the frame member and rotation of the extender tube in a second direction with respect to the threaded projection moves the second end of the extender tube towards the first end of the frame member. The method may include providing a lock having an engaged position and a disengaged position, wherein the lock in the engaged position prevents rotation of the extender tube with respect to the threaded projection.

Figure 1:
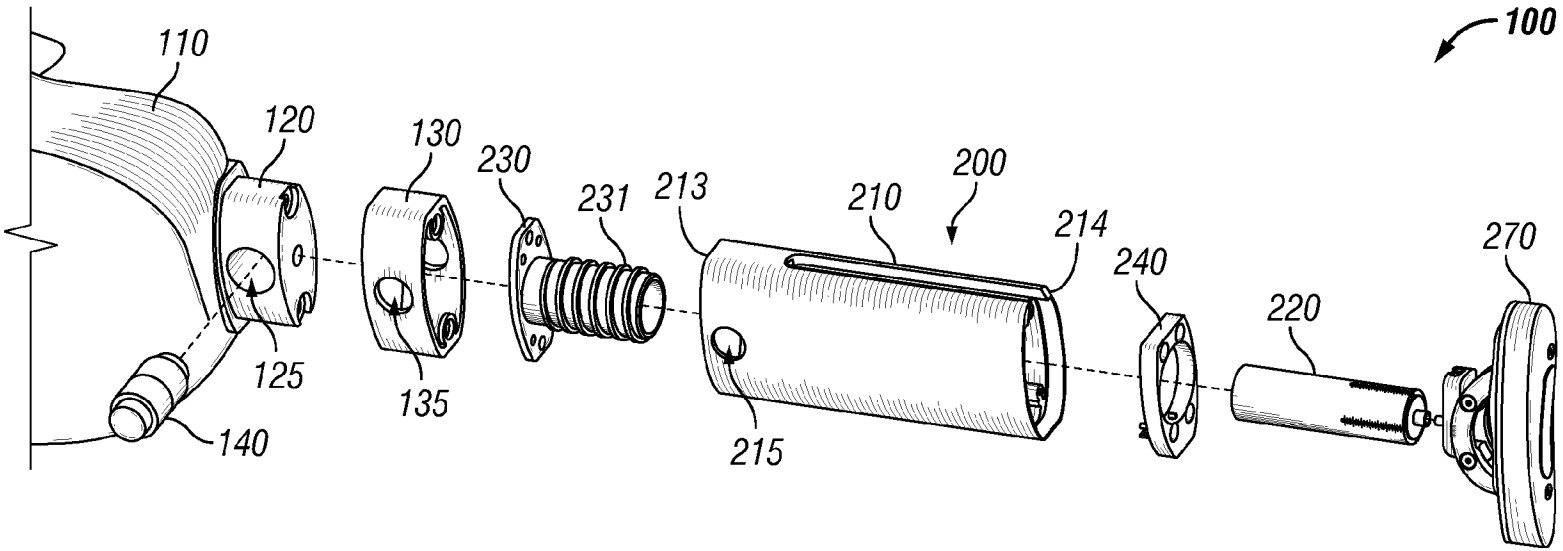
FIG. 1 shows an exploded view of an embodiment of a firearm stock connection system with a stock system.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the disclosure as defined by the appended claims.

DETAILED DESCRIPTION

FIG. 1 shows one embodiment of a firearm stock connection system 100 comprised of a grip 110, a, ferrule 130, a stock system 200, and a quick release button 140. The grip 110 includes a protrusion 120. A first hole 125 extends through the protrusion 120. The stock system 200 includes a frame member 210 having a first side 211 and a second side 212 (shown in FIG. 2B). A second hole 215 extends from the first side 211 to the second side 212 of the frame member 210. The ferrule 130 has a first side 131 and a second side 132 (shown in FIG. 2B) with a third hole 135 extending from the first side 131 to the second side 132. The ferrule 130 may be positioned on the protrusion 120 such that the first hole 125 and a third hole 135 are aligned. The first hole 125 may have a larger cross-section than a cross-section of the third hole 135. A ferrule may be advantageous to increase the strength of the protrusion 120 and prevent splitting. Furthermore, the ferrule 130 may retain the quick release button 140 within the protrusion 120 of the grip 110. The ferrule 130 may be affixed to the protrusion 120 by various mechanisms as would be appreciated by one of ordinary skill in the art having the benefit of this disclosure. For example, the ferrule 130 may include screw holes between the first side 131 and the second side 132 (shown in FIG. 2B) that align with holes in the protrusion 120. Before insertion of the ferrule 130 onto the protrusion 120, the quick release button 140 may be positioned within the first hole 125 of the protrusion 120. The stock system 200 may be placed over the ferrule 130 such that the first hole 125, second hole 215, and third hole 135 are aligned. The first hole 125 may have a larger cross-section than a cross-section of the second hole 215.

Figure 2A:
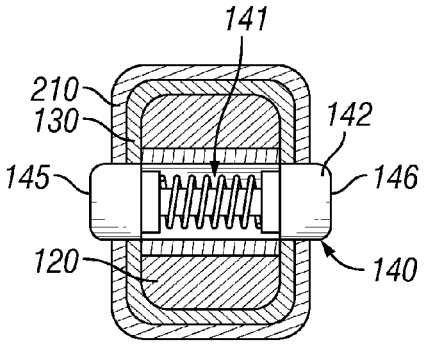
FIG. 2A shows a cross-section of an embodiment of a quick release button retained within a grip by a ferrule and in an extended position.
Figure 2B:
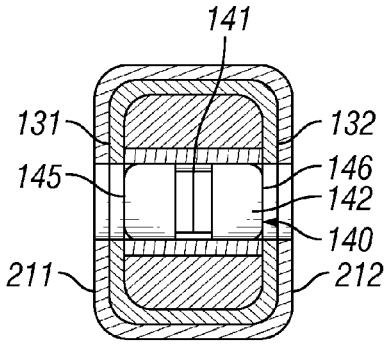
FIG. 2B shows a cross-section view of the embodiment of FIG. 2A with the quick release button retained within the grip by the ferrule and in a compressed position.

The quick release button 140 may selectively connect the grip 110 to the stock system 200. FIG. 2A shows a cross-section view of the protrusion 120 of the grip 110, ferrule 130, and frame 210 of the stock system 200 connected by the quick release button 140 when in the extended position. The quick release button 140 may have a first portion 141 positioned within the first hole 125 and a second portion 142 that extends beyond the surface of the grip protrusion 120, the ferrule 130, and the frame 210. The second portion 142 may have a smaller cross-section than the first portion 141. The larger cross-section of the first portion 141 may abut against an inner surface of the ferrule 130 and thereby be secured within the protrusion 120 of the grip 110. Accordingly, the quick release button 140 can be compressed and released and the first portion 141 remains positioned within the first hole 125. The second portion 142 may extend beyond the ferrule 130 and through the second hole 215 of the frame member 210. A first end 145 and a second end 146 of the quick release button 140 may extend through the second hole 215. The quick release button 140 has an extended position (shown in FIG. 2A) and a compressed position (shown in FIG. 2B). In the extended position the first and second ends 145, 146 of the button 140 are positioned outside of the frame member 210. In the compressed position, the first and second ends 145, 146 of the button 140 are positioned inside of the frame member 210. The button 140 selectively connects the grip 110 to the frame member 210 of the stock system 200 when the button 140 is in the extended position. The quick release button 140 may be biased in an extended position.

The quick release button 140 may be compressed and the ferrule 130 may be inserted over the grip protrusion 120. When the first hole 125 and the third hole 135 are aligned, the quick release button 140 may return to its biased extended position. In its biased extended position, the quick release button 140 selectively connects the grip 110 to the ferrule 130. The quick release button 140 may again be compressed by applying force to the first and second ends 145, 146 of the button 140 and the frame member 210 may be inserted over the ferrule 130. When the first hole 125 and the second hole 215 are aligned, the quick release button 140 may return to its biased extended position and selectively connect the stock system 200 to the grip 110. The stock system 200 may be disconnected from the grip 110 by applying force to the first and second ends 145, 146 of the button 140 until the first and second ends 145, 146 are positioned within the ferrule 130. The stock system 200 may then be removed from the grip 110.

Figure 3A:
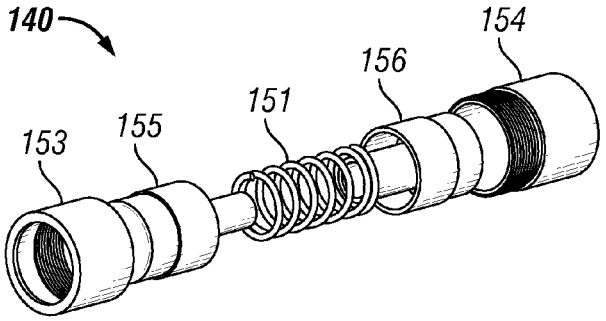
FIGS. 3A-3B show an embodiment of a quick release button.
Figure 3B:
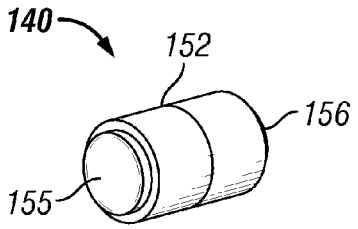

FIGS. 3A-3B show an embodiment of the quick release button 140. A button sleeve 152 may include a first sleeve portion 153 and a second sleeve portion 154. The first sleeve portion 153 may have female threads and the second sleeve portion 154 may have male threads. The first sleeve portion 153 may be threaded upon the second sleeve portion 154 to create a sleeve 152 having a first end and a second end. The non-adjoining ends of the first sleeve portion 153 and second sleeve portion 154 may have smaller openings than the openings of the adjoining ends. Accordingly, the sleeve 152 may have end openings having a smaller cross-section than the internal cross section of the sleeve. A first post 155 and a second post 156 may be contained within the sleeve 152. A portion of the first post 155 extends beyond the first end of the sleeve 152 and a portion of the second post 156 extends beyond the second end of the sleeve 152. A spring 151 may be positioned between the first post 155 and the second post 156 to bias the posts 155, 156 against the ends of the sleeve 152. When a force is applied to the posts 155, 156, the spring 151 is compressed and the distance between the ends of the posts 155, 156 is reduced. When the force is released, the posts 155, 156 return to a biased extended position.

Figure 4:
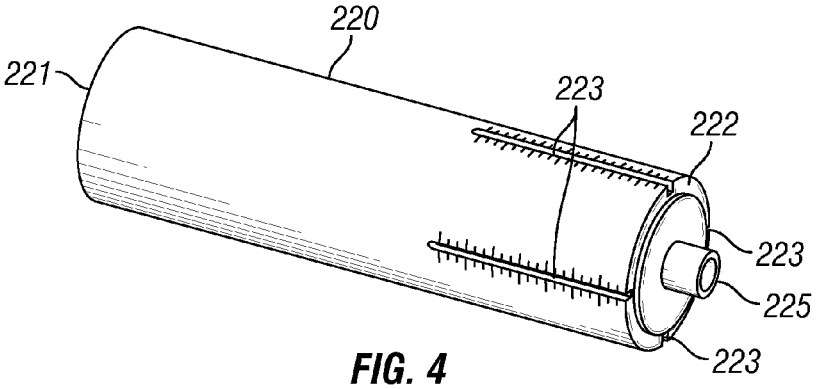
FIG. 4 is an embodiment of an extender tube having grooves.
Figure 5A:
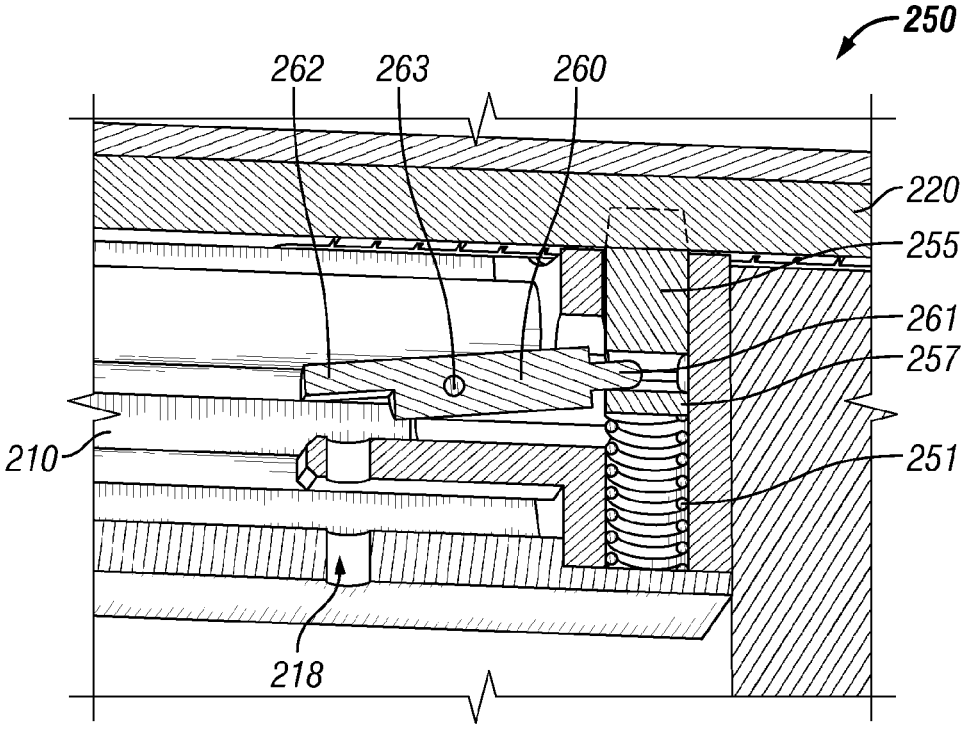
FIG. 5A shows an embodiment of a lock positioned within a frame member and in an engaged position with a portion of the lock engaging an extender tube.
Figure 5B:
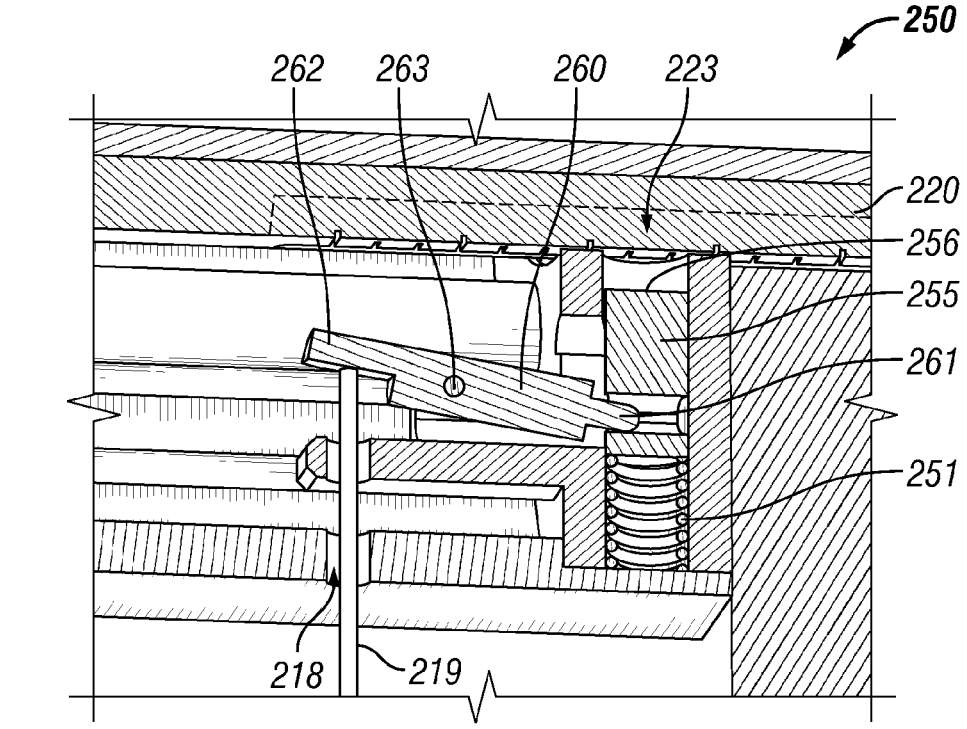
FIG. 5B shows the embodiment of FIG. 5A with a member actuating the lock in a disengaged position.

One embodiment of a stock system 200 (shown in FIG. 1) is an adjustable stock system comprised of a frame member 210, an extender tube 220, a plate 230, and a lock 250 (shown in FIGS. 5A-5B). The frame member 210 has a first end 213 and a second end 214. The plate 230 is connected to the first end 213 of the frame member 210. The plate 230 has a threaded projection 231 extending toward the second end 214 of the frame member 210. In some embodiments, the plate 230 is attached to the first end 213 the frame member 210 by screws and the plate 230 is positioned entirely within the frame member 210. The threaded projection 231 of the plate 230 may extend through the frame member 210 toward the butt plate 270 of the stock system 200. The extender tube 220 has a first end 221 and a second end 222 (shown in FIG. 4). The first end 221 of the extender tube 220 may be internally threaded. The first end 221 of the extender tube 220 may be threaded onto the threaded projection 231 of the plate 230. Rotation of the extender tube 220 in a first direction with respect to the threaded projection 231 moves the second end 222 of the extender tube 220 away from the first end 213 of the frame member 210. Rotation of the extender tube 220 in a second direction with respect to the threaded projection 231 moves the second end 222 of the extender tube 220 toward the first end 213 of the frame member 210. The lock 250 has an engaged position (shown in FIG. 5A) and a disengaged position (shown in FIG. 5B). In the disengaged position, the extender tube 220 may rotate with respect to the threaded projection 231. In the engaged position, the lock 250 prevents rotation of the extender tube with respect to the threaded projection 231.

Figure 10A:
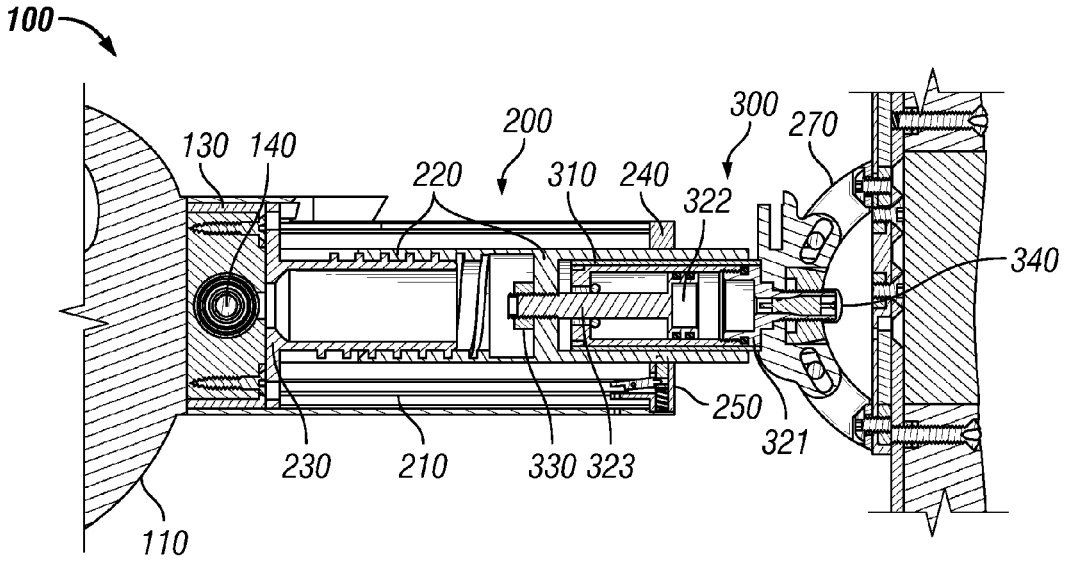
FIG. 10A shows a schematic cross-section view of the embodiment of FIG. 7 in a first position.
Figure 10B:
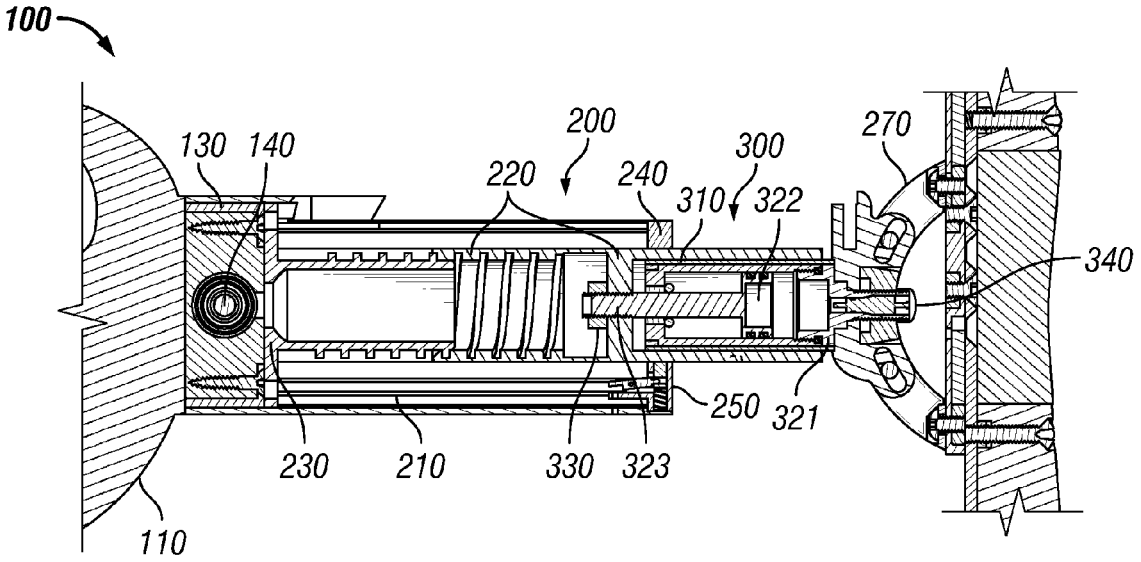
FIG. 10B shows the embodiment of FIG. 10A in a second position, wherein the extender tube has been rotated in relation to the plate.

FIG. 4 shows an embodiment of an extender tube 220. The extender tube 220 includes at least one structure positioned along a surface of the extender tube 220. The at least one structure positions correspond with the position of a pin 255 (shown in FIG. 6A) that intersects the path of rotation of the extender tube 220. A portion of the lock 250 in the engaged position engages the at least one structure and prevents rotation of the extender tube 220 with respect to the threaded projection 231. By way of example, the at least one structure may be a slot, cavity, groove, depression, projection, or hole. A groove may be a desirable structure because it allows for multiple intersection points and maintains a minimal wall thickness to increase the strength of the extender tube 220. In one embodiment, the structures may be a plurality of grooves 223 positioned around the exterior surface of the extender tube 220. For example, a quarter-rotation of the extender tube 220 may move the second end 222 of the extender tube 220 one-sixteenth of an inch away from the second end 214 of the frame member 210. Before rotation (shown in FIG. 10A), the pin 255 is aligned with a first groove 223. After rotation, the pin 255 is aligned with an adjacent groove 223. The second end 222 of the extender tube 220 has been moved away from the second end 214 of the frame member 210 (shown in FIG. 10B). The pin 255 may again be positioned within the adjacent groove 223 to prohibit rotation of the extender tube 220 in relation to the threaded projection 231 of plate 230. An extender tube connector 225 may be located at the second end 222 of the extender tube 220. The extender tube connector 225 may secure the extender tube 220 to a butt plate 270 (shown in FIG. 1). The extender tube connector 225 may enable the extender tube 220 to freely rotate with respect to the butt plate 270 while remaining connected to the butt plate 270.

FIG. 5A shows an embodiment of a lock 250 in the engaged position. The lock 250 may be positioned within the frame member 210. The lock 250 includes a pin 255 that engages a structure, such as groove 223, of the extender tube 220 when the lock 250 is in an engaged position and prevents rotation of the extender tube 220. For example, the lock 250 is in the engaged position when the pin 255 is positioned within the groove 223 of the extender tube 220. In the engaged position, the pin 255 prevents rotation of the extender tube 220 with respect to the threaded projection 231. The pin 255 has a first end 256 (shown in FIG. 5B) and a second end 257. The first end 256 of the pin 255 is configured to engage a structure on the extender tube 220 to prevent rotation of the extender tube 220 with respect to the threaded projection 231. For example, the first end 256 of the pin 255 may extend within the groove 223. A spring 251 may contact the second end 257 and bias the first end 256 of the pin 255 in an engaged position. A pivot arm 260 may actuate the pin 255 between the engaged position and the disengaged position (shown in FIG. 5B). A first end 261 of the pivot arm 260 may engage the pin 255. For example, in one embodiment the first end 261 of the pivot arm 260 may contact a collar between the first end 256 of the pin 255 and the second end 257 of the pin 255. A second end 262 of the pivot arm 260 may be manipulated about a pivot point 263 such that manipulation of the second end 262 moves the first end 261 with respect to the extender tube 220. The pivot point 263 may be integrated into the lock plate 240 (shown in FIGS. 6A and 6B). An access aperture 218 may extend through a portion of the frame member 210 and provide access to the second end 262 of the pivot arm 260. A member 219, such as a wrench, rod, or bullet may be inserted through the access aperture 218 to manipulate the position of the second end 262 of the pivot arm 260. In some embodiments, the member 219 may be connected to the frame member 210. For example, the member 219 may have a button end that extends beyond the frame member 210. The second end 262 of the pivot arm 260 may be manipulated in other ways as may be appreciated by one of ordinary skill in the art having the benefit of this disclosure.

By means of example, a user may adjust the length of the firearm stock system 200. The stock system 200 may be in a first position (shown in FIG. 10A) with the first end 256 of the pin 255 engaged in a groove 223 (shown in FIG. 5A). While in the engaged position, the pin 255 prohibits rotation of the extender tube 220 with respect to the threaded projection 231. The user may actuate the second end 262 of the pivot arm 260 by placing a member 219 through the access aperture 218 in the frame member 210. Actuation of the second end 262 of the pivot arm 260 exerts a force against the spring 251 and removes the first end 256 of the pin 255 from within the groove 223 (shown in FIG. 5B). This is the disengaged position. While in the disengaged position, the user may rotate the extender tube 220 without interference by the pin 255. The extender tube 220 may be rotated by direct manipulation or indirectly. An example of indirect manipulation would be the application of force to the butt plate 270 away from the second end 214 of the frame member 210, wherein the force causes the extender tube 220 to advance along the threaded projection 231 of the plate 230. The extender tube 220 may be rotated along its axis of rotation to a desired second position (shown in FIG. 10B). In the second position, a groove 223 is in alignment with the pin 255. The user may release the second end 262 of the pivot arm 260. The force of spring 251 engages the first end 256 of the pin 255 within the groove 223 at the second position. The pin 255 prohibits rotation of the extender tube 220 with respect to the threaded projection 231 in the second position.

Figure 6A:
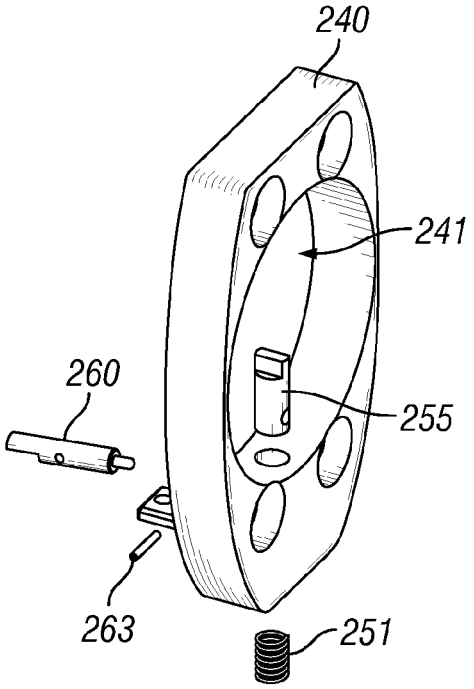
FIGS. 6A-6B show an embodiment of a lock plate.
Figure 6B:
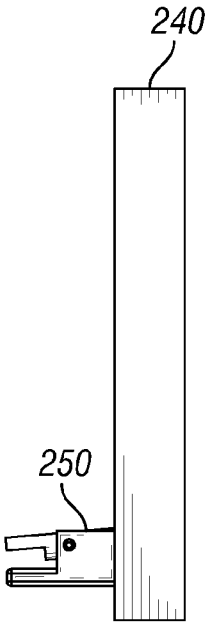

FIGS. 6A-B show an embodiment of a lock plate 240 with a lock 250 contained within. An aperture 241 may allow the extender tube 220 (shown in FIG. 5) to extend through the lock plate 240 such that the pin 255 may engage a structure of the extender tube 220. The aperture 241 is configured to allow the extender tube 220 to rotate within the aperture 241 when the lock 250 is in the disengaged position. The lock plate 240 may be connected to the second end 214 of the frame member 210. The lock plate 240 may contained within the frame member 210.

Figure 7:
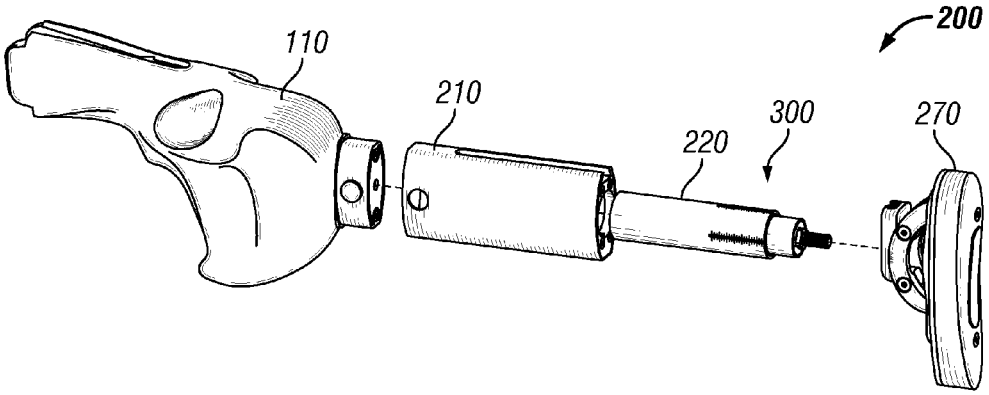
FIG. 7 shows an embodiment of an adjustable stock system having a recoil device.
Figure 8:
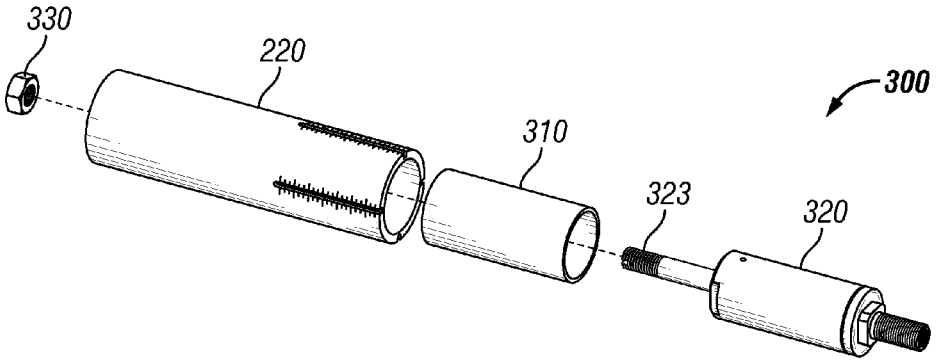
FIG. 8 is an exploded partial view of the embodiment of FIG. 7.

FIG. 7 shows an embodiment of an adjustable stock system 200 with a recoil device 300. The recoil device 300 dampens the recoil force transferred through the butt plate 270 when a firearm is discharged. The recoil device 300 may include a sleeve 310 and dampening chamber 320 (shown in FIG. 8). The dampening chamber 320 may be positioned within the sleeve 310 so that the dampening chamber 320 may slide within the sleeve 310 with minimal friction. The sleeve 310 may also permit the dampening chamber 320 to rotate within the sleeve 310. The sleeve 310 may be a DELRIN sleeve commercially offered by DuPont of Wilmington, Del. The sleeve 310 is positioned at least partially within the extender tube 220. A portion of the recoil device 300 is connected to the extender tube 220 to prevent movement between the extender tube 220 and the portion of the recoil device 300. The recoil device 300 may be further connected to the butt plate 270.

Figure 9:
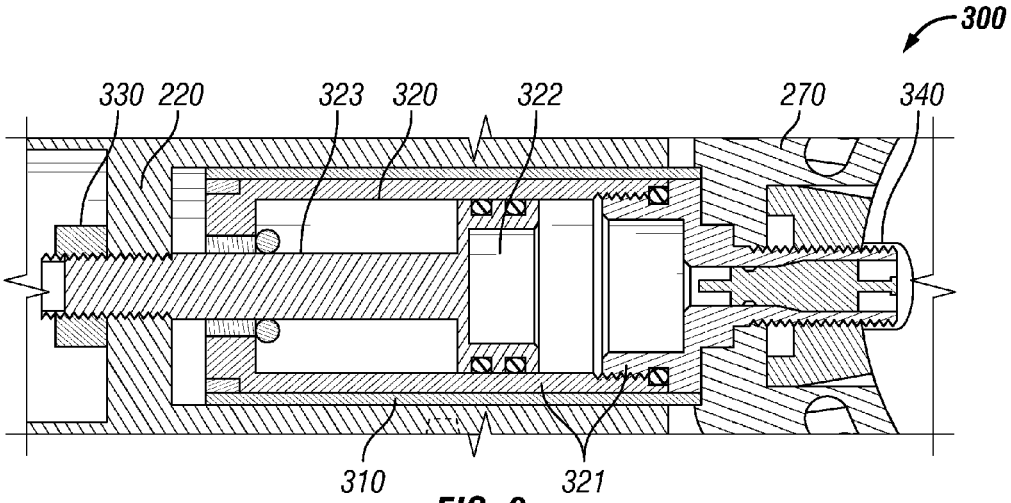
FIG. 9 shows a cross-section view of the embodiment of FIG. 8 with a sleeve positioned within an extender tube and the recoil device positioned within the sleeve, a portion of the recoil device is threaded into a portion of the extender tube.

FIG. 9 shows a cross section view of the recoil device 300 with the sleeve 310 positioned within the extender tube 220 and the recoil device 300 positioned within the sleeve 310. The dampening chamber 320 may have a cylinder 321, a piston head 322, and a piston rod 323. The piston head 322 slides within the cylinder 321 and compresses a fluid between the piston head 322 and the cylinder 321. The piston rod 323 is connected with the piston head 322 and is secured to the extender tube 220. By way of example, the extender tube 220 may have an inner threaded cross-section. The piston rod 323 may be threaded and be threaded into the inner threaded cross-section of the extender tube 220. A nut 330 may further secure the piston rod 323 to the extender tube 220. In operation, recoil from a firearm is transferred into the extender tube 220. The extender tube 220, through its connection with the piston rod 323, transfers the recoil force into the dampening chamber 320. The force of the recoil moves the piston head 322 further into the cylinder 321. An opposing force exerted upon the cylinder 321 through its connection with the butt plate 270 prevents the cylinder 321 from being pushed out of the sleeve 310 by the piston head 322. The sleeve 310 may slide within the extender tube 220 as the force of the recoil moves the piston head 322 further into the cylinder 321. In some embodiments, the cylinder 321 may slide within the sleeve 310. A fluid is compressed between the piston head 322 and the cylinder 321. The compression of the fluid dampens the recoil force felt by a user. A valve 340 may be connected to the dampening chamber 320 to allow the amount, pressure, and composition of the fluid within the dampening chamber 320 to be altered. In some embodiments, the fluid is atmospheric gases and the valve 340 is a SCHRADER valve. The valve 340 may be concealed behind a portion of the butt plate 270. The portion of the butt plate 270 may be tilted to provide access to the valve 340.

The recoil device 300 may be connected to the butt plate 270. In some embodiments, the connection may enable the extender tube 220 and recoil device 300 to freely rotate with respect to the butt plate 270 while remaining connected to the butt plate 270. In some embodiments, the recoil device is rigidly connected to the butt plate 270. As a user rotates the extender tube 220, the piston rod 323 and piston head 322, which are connected to the extender tube 220, rotate with the extender tube 220. The piston head 322 rotates within the cylinder 321. The sleeve 310 may permit extender tube 220 to rotate with respect to the cylinder 321.

Figure 11A:
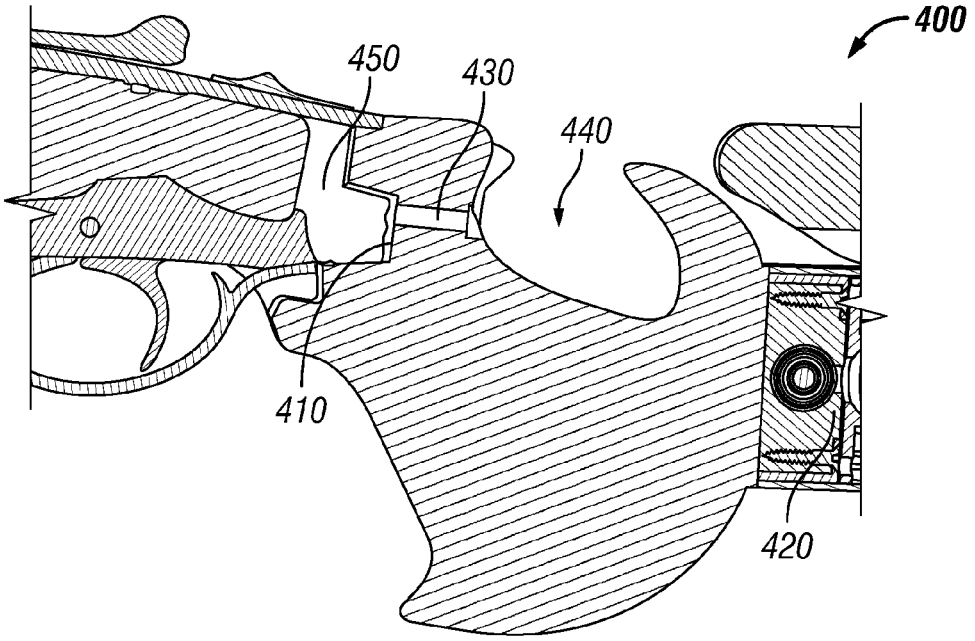
FIG. 11A shows an embodiment of a firearm grip having a first end, a second end, and a bolt aperture extending from the first end to a gap between the first end and the second end.
Figure 11B:
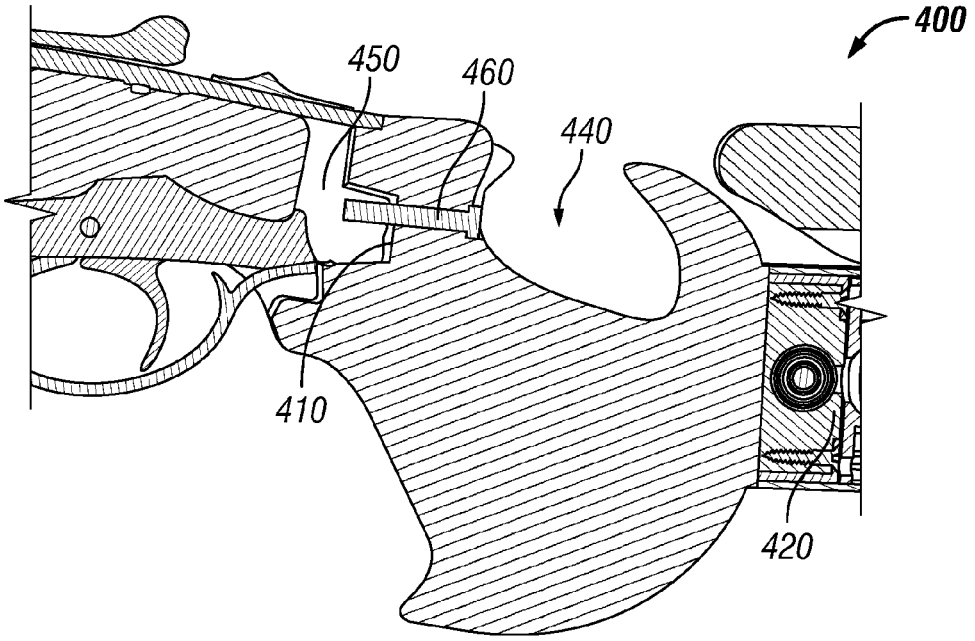
FIG. 11B shows the embodiment of FIG. 11A with a bolt extending through the bolt aperture and connecting a firearm grip to a receiver of a firearm.

FIG. 11A shows an embodiment of a firearm grip 400 having a first end 410, a second end 420, and a bolt aperture 430 extending from the first end 410 to a gap 440 between the first end 410 and the second end 420. The bolt aperture 430 may extend through an upper portion of the grip 400. The gap 440 may be a thumbhole as may be appreciated by one of ordinary skill in the art. A bolt 460 (shown in FIG. 11B) may be attached through the bolt aperture 430 to attached the firearm grip 400 to the receiver 450 of the firearm. The head of the bolt 460 may be countersunk within a surface of the gap 440.

The second end 420 of the firearm grip 400 may be configured to attach to a firearm stock system 200 as may be appreciated by one of ordinary skill in the art having the benefit of this disclosure. For example, the second end 420 of the grip 400 may include a protrusion having a hole for a quick release button as described herein. The orientation of the bolt aperture 430 may be beneficial to mount the grip 400 to provide more leverage, orient the firearm stock system 200 in a lower position with respect to the receiver 450, and prevent the attachment between the grip 400 and the receiver 450 from interfering with the function and placement of the stock system 200 as would be appreciated by one of ordinary skill in the art having the benefit of this disclosure.

Although this disclosure has been described in terms of certain preferred embodiments, other embodiments that are apparent to those of ordinary skill in the art, including embodiments that do not provide all of the features and advantages set forth herein, are also within the scope of this disclosure. Accordingly, the scope of the present disclosure is defined only by reference to the appended claims and equivalents thereof.

What is claimed is:

1. An adjustable firearm stock system comprising:

a frame member having a first end and a second end;

a plate connected to the first end of the frame member, the plate having a threaded projection that extends toward the second end of the frame member;

an extender tube having a first end and a second end, the extender tube being positioned at least partially within the frame member, the first end of the extender tube being threaded onto the threaded projection, wherein rotation of the extender tube in a first direction with respect to the threaded projection moves the second end of the extender tube away from the first end of the frame member and rotation of the extender tube in a second direction with respect to the threaded projection moves the second end of the extender tube towards the first end of the frame member; and a lock having an engaged position and a disengaged position, wherein the lock in the engaged position prevents rotation of the extender tube with respect to the threaded projection.

2. The system of claim 1, wherein the lock is contained within a lock plate connected to the second end of the frame member, wherein the lock plate has an aperture configured to allow the extender tube to rotate within the aperture when the lock is in the disengaged position.

3. The system of claim 1, wherein the extender tube further comprises at least one structure, wherein a portion of the lock in the engaged position engages the at least one structure to prevent rotation of the extender tube with respect to the threaded projection.

4. The system of claim 3, wherein the lock comprises:

a pin having a first end, wherein the first end of the pin engages the at least one structure when the lock is in the engaged position; and a pivot arm having a first end and a second end, the first end of the pivot arm engaging the pin, wherein actuating the second end of the pivot arm moves the first end of the pin away from the at least one structure.

5. The system of claim 4, wherein the lock further comprises a spring, wherein the spring biases the first end of the pin in the engaged position with the at least one structure.

6. The system of claim 4, wherein the frame member further comprises an access aperture, wherein a member inserted through the access aperture may actuate the second end of the pivot arm.

7. The system of claim 3, wherein the at least one structure is a slot, cavity, groove, depression, projection, or hole.

8. The system of claim 3, wherein the at least one structure is four slots equidistantly positioned around the perimeter of the extender tube.

9. The system of claim 1, further comprising a recoil device.

10. The system of claim 9, wherein the recoil device comprises:

a cylinder having a connector configured to attach a butt plate to the recoil device;

a piston having a piston head and a piston rod, the piston head positioned within the cylinder, the piston rod connected to the extender tube; and a fluid positioned between the piston head and the cylinder.

11. The system of claim 10, wherein the cylinder further comprises a valve and wherein the fluid is a gas.

12. The system of claim 10, wherein the cylinder is positioned at least partially within the extender tube and wherein the connector extends beyond the second end of the extender tube.

13. The system of claim 1, wherein the frame member further comprises a first side, a second side, and a second hole that extends from the first side to the second side of the frame member, and wherein the system further comprises:

a grip having a first hole; and a button positioned within the first hole of the grip, the button having a first end, a second end, an extended position, and a compressed position, wherein in the extended position a portion of the button extends through the second hole of the frame member and the first and second ends of the button are positioned outside of the frame member, wherein in the compressed position the first and second ends of the button are positioned within the frame member, and wherein the button selectively connects the grip to the frame member of the stock system when the button is in the extended position.

* * * * *